US008095052B2

(12) United States Patent
Nishiwaki et al.

(10) Patent No.: US 8,095,052 B2
(45) Date of Patent: Jan. 10, 2012

(54) DEVELOPER SUPPLY DEVICE

(75) Inventors: Kenjiro Nishiwaki, Aichi (JP); Kazutoshi Kotama, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 132 days.

(21) Appl. No.: 12/730,569

(22) Filed: Mar. 24, 2010

(65) Prior Publication Data

US 2010/0247127 A1 Sep. 30, 2010

(30) Foreign Application Priority Data

Mar. 25, 2009 (JP) ..... 2009-074356

(51) Int. Cl.
*G03G 15/08* (2006.01)

(52) U.S. Cl. ..... 399/281; 399/258; 399/262; 399/291

(58) Field of Classification Search ..... 399/252, 399/258, 262, 265–267, 281, 289, 290, 291
See application file for complete search history.

(56) References Cited

U.S. PATENT DOCUMENTS 5,210,551 A * 5/1993 Inoue et al. ..... 347/141
6,272,296 B1 8/2001 Gartstein
6,697,592 B2 * 2/2004 Adachi et al. ..... 399/265
6,934,496 B2 * 8/2005 Sakuma et al. ..... 399/265
7,062,204 B2 * 6/2006 Miyaguchi et al. ..... 399/252

FOREIGN PATENT DOCUMENTS

JP 60-115962 6/1985
JP 11-084862 3/1999
JP 2001-209246 8/2001
JP 2002-287495 10/2002

* cited by examiner

*Primary Examiner* — Hoang Ngo
(74) *Attorney, Agent, or Firm* — Banner & Witcoff, Ltd.

(57) ABSTRACT

A developer supply device, comprising a casing having: a developer reservoir at a bottom part of the casing; a developer amount adjustment chamber provided close to a side of the developer reservoir to communicate with a top portion of the developer reservoir; and a communication part through which the top portion of the developer reservoir and the developer amount adjustment chamber communicate with each other, and further comprising: a carrying substrate having electrodes arranged along a developer transport path to carry a developer through a traveling electric field, each of the electrodes having a longer side extending in a width direction of the developer reservoir, and a developer providing unit to provide the developer into the developer reservoir, and wherein the carrying substrate comprises an upper carrying substrate on an inner wall of the casing on an opposite side of the communication part to carry the developer upward.

12 Claims, 6 Drawing Sheets

DEVELOPER SUPPLY DEVICE

CROSS-REFERENCE TO RELATED APPLICATION

This application claims priority under 35 U.S.C. §119 from Japanese Patent Application No. 2009-074356, filed on Mar. 25, 2009. The entire subject matter of the application is incorporated herein by reference.

BACKGROUND

1. Technical Field

Aspects of the present invention relate to a developer supply device configured to carry a charged developer through an electric field to supply the charged developer to a supply target.

2. Related Art

Developer supply devices configured to supply a charged developer to a supply target have been widely used. One of such developer supply devices is configured to have a plurality of carrying electrodes arranged along a developer transport direction so that the developer can be carried through an electric field generated by voltage application to the plurality of electrodes.

SUMMARY

It is understood that, in such a developer supply device, if a supply state of the developer is deteriorated due to, for example, deterioration of the developer in the developer supply device or occurrence of retention of the developer in the developer supply device, the quality of a formed image is deteriorated.

Aspects of the present invention are advantageous in that a developer supply device configured to bring a supply state of a developer to a suitable state so that excellent image formation can be performed is provided.

According to as aspect of the invention, there is provided a developer supply device, comprising a casing having: a developer reservoir provided at a bottom part of the casing to accommodate a developer; a developer amount adjustment chamber provided close to a side of the developer reservoir to communicate with a top portion of the developer reservoir; and a communication part through which the top portion of the developer reservoir and the developer amount adjustment chamber communicate with each other. The developer supply device further comprises: a carrying substrate having a plurality of electrodes arranged along a developer transport path to carry a developer along the developer transport path through a traveling electric field, each of the plurality of electrodes having a longer side extending in a width direction of the developer reservoir interesting with the developer transport path, and a developer providing unit configured to provide the developer into the developer reservoir. The carrying substrate comprises an upper carrying substrate that is provided on an inner wall of the casing on an opposite side of the communication part, and is provided to carry the developer upward along the developer transport path.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
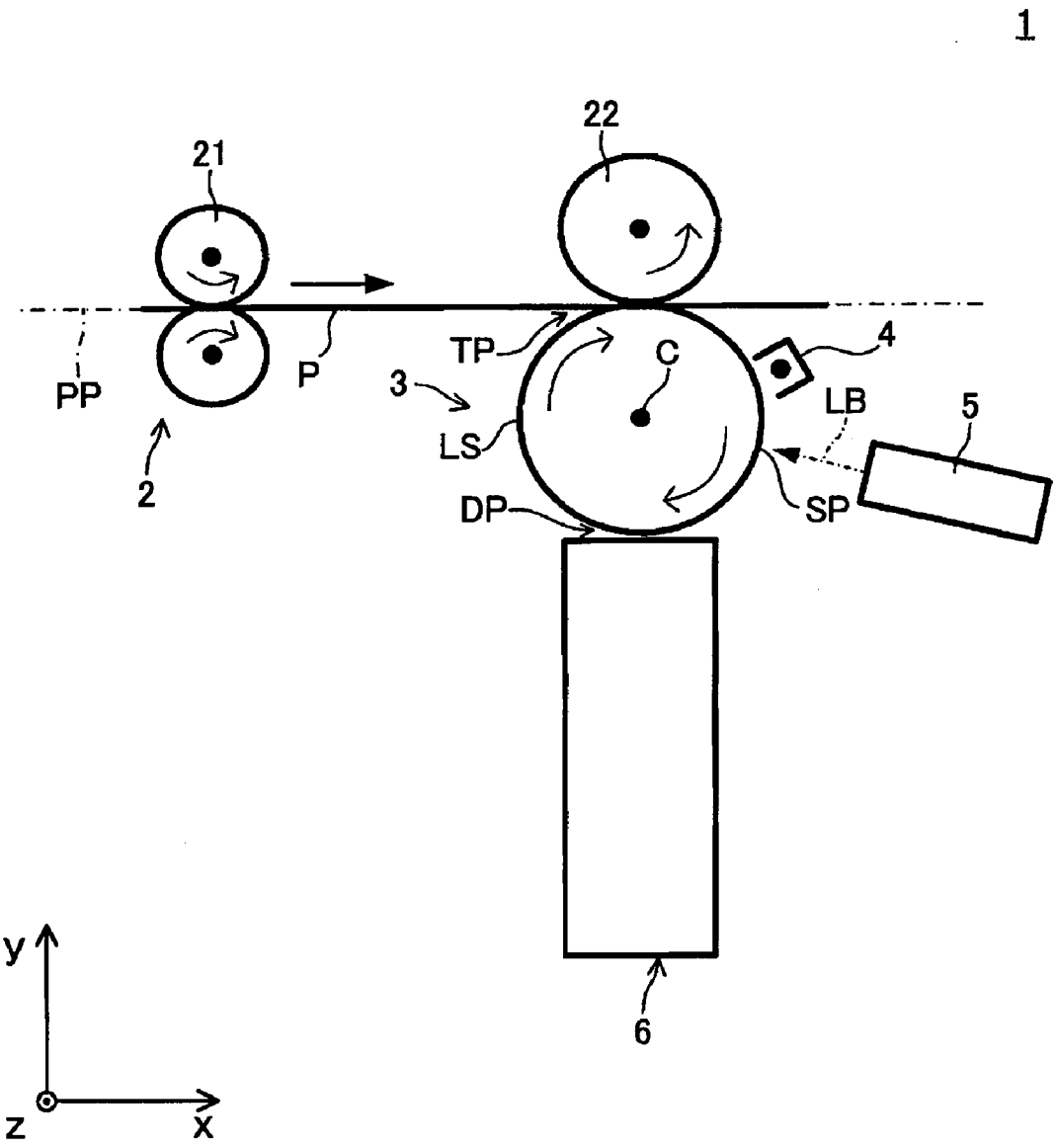
FIG. 1 is a side view illustrating a general configuration of a laser printer according to an embodiment.

As shown in FIG. 1, a laser printer 1 includes a paper carrying mechanism 2, a photosensitive drum 3, a charger 4, a scanning unit 5 and a toner supply unit 6. On a paper supply tray (not shown) provided in the laser printer 1, a stack of sheets of paper is accommodated. The paper carrying mechanism 2 is configured to carry a sheet of paper P along a paper carrying path PP. An outer circumferential surface of the photosensitive drum 3 which is a supply target is formed to be an electrostatic latent image holding surface LS. The electrostatic latent image holding surface LS is formed as a cylindrical surface elongated in parallel with a main scanning direction (i.e., a direction of z-axis in FIG. 1). On the electrostatic latent image holding surface LS, an electrostatic latent image is formed as potential distribution, and toner T (developer) is held at portions corresponding to the electrostatic latent image.

The photosensitive drum 3 is configured to rotate in a direction indicated by an arrow in FIG. 1 (i.e., in the clockwise direction) about the center axis C extending in the main scanning direction. That is, the photosensitive drum 3 is configured such that the electrostatic latent image holding surface LS moves along an auxiliary scanning direction which is perpendicular to the main scanning direction.

The charger 4 is located to face the electrostatic latent image holding surface LS. The charger 4 is a corotron type charger or a scorotron charger, and is configured to charge uniformly the electrostatic latent image holding surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the electrostatic latent image holding surface LS. The scan position SP is located on the downstream side in the rotational direction of the photosensitive drum 3 with respect to the charger 4.

Further, the scanning unit 5 is configured to scan the laser beam LB, at the converged position, on the electrostatic latent image holding surface LS in the main scanning direction at a constant speed, so that an electrostatic latent image is formed on the electrostatic latent image holding surface LS.

The toner supply unit 6 is located under the photosensitive drum 3 to face the photosensitive drum 3. The toner supply unit 6 is configured to supply the toner T, which is in a charged state, to the electrostatic latent image holding surface LS at a development position DP. The development position DP is a position at which the toner supply unit 6 faces the electrostatic latent image holding surface LS. The detailed configuration of the toner supply unit 6 is explained later.

Hereafter, each of the components of the laser printer 1 is explained in detail.

The paper carrying mechanism 2 includes a pair of registration rollers 21, and a transfer roller 22. The pair of registration rollers 21 is configured to send the sheet of paper P at predetermined timing toward a position between the transfer roller 22 and the photosensitive drum 3.

The transfer roller 22 is located such that the sheet of paper P is sandwiched at a transfer position TP between the transfer roller 22 and the photosensitive drum 3. Further, the transfer roller 22 is configured to be rotated in the direction indicated by an arrow in FIG. 1 (i.e., in the counterclockwise direction).

The transfer roller 22 is connected to a bias power source (not shown) so that a predetermined transfer voltage for transferring the toner adhered on the electrostatic latent image holding surface LS to the sheet of paper P is applied thereto.

Figure 2:
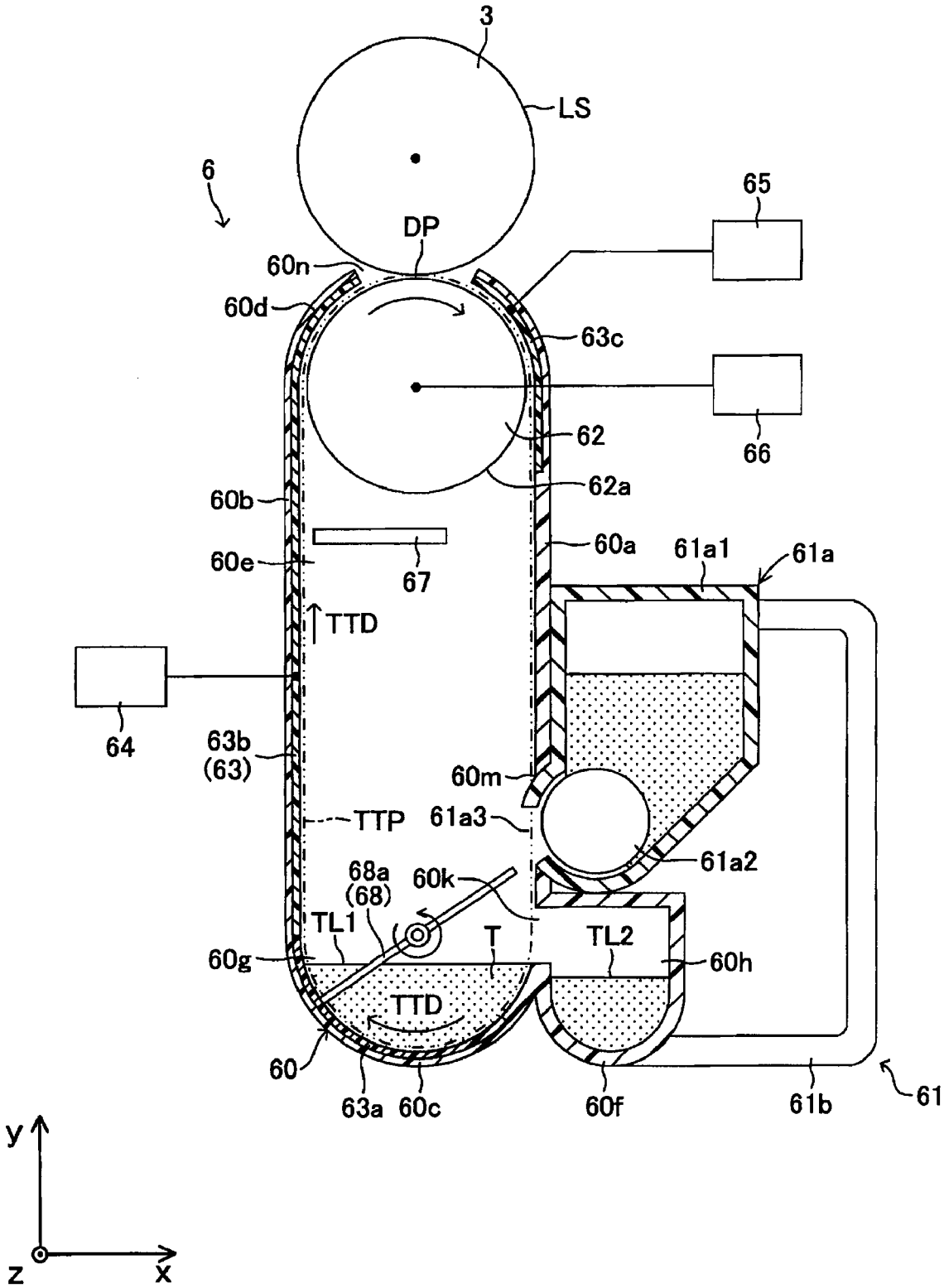
FIG. 2 is a side cross section illustrating an internal configuration of a toner supply unit provided in the laser printer.

As shown in FIG. 2, the toner supply unit 6 is configured to supply the charged toner T to the photosensitive drum 3 while carrying the toner T along a toner transport path TTP through an electric field.

A casing 60 of the toner supply unit 6 is a box type member having an elliptical shape when viewed as a side cross section, and is positioned such that the longer side thereof is in parallel with the vertical direction (i.e., the direction of y-axis). Inside the casing 60, the toner T which is dry type powdery developer is accommodated. In this embodiment, the toner T has a positive electrostatic property, and is single component black toner having a nonmagnetic property.

The casing 60 is integrally formed with a front panel 60*b*, a rear panel 60*a*, a bottom plate 60*c*, a top plate 60*d*, a pair of side walls 60*e*, and an auxiliary tank 60*f*. The casing 60 is integrally formed of synthetic resin.

The rear panel 60*a* is a plate-like member elongated in parallel with the main scanning direction and the height direction, and is provided to stand perpendicularly to the horizontal surface. The rear panel 60*a* has an upper end portion formed to be thinner than the other portion of the rear panel 60*a*.

The front panel 60*b* is a plate-like member provided to be parallel with the rear panel 60*a*, and has a thickness equal to the thickness of the upper end portion of the rear panel 60*a*. The front panel 60*b* and the rear panel 60*a* are provided to face with each other. More specifically, the front panel 60*b* and the rear panel 60*a* are positioned such that the upper edges of the front panel 60*b* and the rear panel 60*a* have the same height and are formed to be parallel with the main scanning direction.

The bottom plate 60*c* is a semispherical cylindrical member having a center axis extending in the main scanning direction, and is connected to the lower ends of the rear panel 60*a* and the front panel 60*b*. The bottom plate 60*c* is formed such that a part of the bottom plate 60*c* other than a joint portion with the rear panel 60*b* has the thickness equal to the thickness of the front panel 60*b*.

The top plate 60*d* is a cylindrical thin semispherical member having a center axis extending in the main scanning direction. The top plate 60*s* is connected to upper ends of the front panel 60*b* and the rear panel 60*a*. The top plate 60*d* is formed to have the thickness equal to the front panel 60*b* and the upper portion of the rear panel 60*a*.

The pair of side walls 60*e* are provided to seal sides of a synthetic resin frame which is formed to have an elliptical shape in a side cross sectional view by the front panel 60*b*, the rear panel 60*a*, the bottom plate 60*c* and the top plate 60*s*. A main toner reservoir 60*g* is formed at a bottom part of a space surrounded by the casing 60, the front panel 60*b*, the rear panel 60*a*, the bottom plate 60*c*, the top plate 60*s* and the pair of side walls 60*e*. The main toner reservoir 60*g* is formed to have a capacity for storing a predetermined amount of toner T.

At the lower end portion of the casing 60, an auxiliary tank 60*f* is provided close to the main toner reservoir 60*g*. More specifically, the auxiliary tank 60*f* is located to be adjacent to the main toner reservoir 60*g* on the rear panel 60*a* side.

The auxiliary tank 60*f* is a box type member having the longer side extending in the main scanning direction, and is configured such that the width in the main scanning direction is equal to the width of the casing 60 in the main scanning direction. In this embodiment, the lower half of the auxiliary tank 60*f* is formed to have a cylindrical thin semispherical shape opened on the upper side. The upper half of the auxiliary tank 60*f* is formed to have a form of an inversed letter "U" when view as a side cross section, and further is formed to be opened on the lower side. Furthermore, the inner space of the auxiliary tank 60*f* forms a toner amount adjustment chamber 60*h*. That is, the toner amount adjustment chamber 60*h* is formed mainly by the lower half having a semispherical shape.

At the lowermost part of the rear panel 60*a*, a communication hole 60*k* is formed. The communication hole 60*k* is formed to penetrate through the top portion of the main toner reservoir 60*g* and the toner amount adjustment chamber 60*h*. In this embodiment, the communication hole 60*k* is formed continuously through the entire width in the main scanning direction of the main toner reservoir 60*g* and the toner amount adjustment chamber 60*h*. That is, the communication hole 60*k* has the length equal to the entire length in the main scanning direction (i.e., the width direction of the main toner reservoir 60*g*) of the development roller 62.

At the lower end of the rear panel 60*a*, a supplementary toner hole 60*m* which is a through hole is formed above the communication hole 60*k*. In this embodiment, the supplementary toner hole 60*m* is formed continuously throughout the entire length of the rear panel 60*a* in the main scanning direction.

At the top of the top plate 60*d* where the toner supply unit 6 faces the photosensitive drum 3, a toner supply opening 60*n* is formed. The toner supply opening 60*n* is formed to be opened upward toward the photosensitive drum 3.

On the rear panel 60*a* side, a toner state control unit 61 is formed closely to the casing 60. The toner state control unit 61 is formed to control an injecting state of the toner to a main part (i.e., the part where the toner transport path TTP is formed) of the casing 60.

The toner state control unit 61 has a toner injecting unit 61*a*. The toner injecting unit 61*a* is configured to inject the toner T into the main toner reservoir 60*g* at the upper portion with respect to the communication hole 60*k*. In this embodiment, the toner injecting unit 61*a* is configured to inject the toner T uniformly throughout the entire length in the main scanning direction of the main toner reservoir 60*g* (i.e., the width direction of the main toner reservoir 60*g*).

More specifically, the toner injecting unit 61*a* has an injecting case 61*a*1 and an injecting screw 61*a*2 accommodated in the injecting case 61*a*1. The injecting case 61*a*1 is a box-shaped member forming a toner tank configured to store the relatively large amount of toner T. The lower end portion of the injecting case 61*a*1 is attached to the rear panel 60*a* to seal the supplementary toner hole 60*m*.

In the inner space of the lower portion of the injecting case 61*a*1 attached to the rear panel 60*a*, the injecting screw 61*a*2 is provided. The injecting screw 61*a*2 has a cylindrical shaft and a spiral blade formed on the outer surface of the shaft. At the lower end of the injecting case 61*a*1, an injection opening 61*a*3 is formed. The injection opening 61*a*3 is formed continuously throughout the entire length in the main scanning direction of the supplementary toner hole 60*m* so as to communicate with the supplementary toner hole 60*m*.

That is, the toner injecting unit 61*a* is formed to inject the toner T in small portions into the main toner reservoir 60*g* through the injection opening 61*a*3 and the supplementary toner hole 60*m* by rotations of the injecting screw 61*a*2.

The bottom portion of the toner amount adjustment chamber 60*h* and the upper portion of the injecting case 61*a*1 are connected with each other via a toner transport unit 61*b*. The toner transport unit 61*b* includes a flexible tune, and an auger having a spiral coil provided in the flexible tube. The toner transport unit 61*b* is configured to carry the toner T from the bottom portion of the toner amount adjustment chamber 60*h* to the upper portion of the injecting case 61*a*1.

Inside the casing 60, the development roller 62 serving as a developer holding body is accommodated. The development roller 62 is a roller-like member having a toner holding surface 62*a* which is an outer circumferential surface having a center axis extending in the main scanning direction. The development roller 62 is supported in the casing 60 to be rotatable about the center axis.

The development roller 62 is provided to face the photosensitive drum 3 at the toner supply opening 60*n*. That is, the casing 60 and the development roller 62 are located such that the toner holding surface 62*a* of the development roller 62 is closely located at the development position DP with respect to the electrostatic latent image holding surface LS of the photosensitive drum 3 via a predetermined gap (e.g., approximately 500 μm).

In the casing 60, a carrying substrate 63 is provided along the toner transport path TTP. The carrying substrate 63 is fixed on the inner wall of the casing 60. In this embodiment, the carrying substrate 63 includes a bottom carrying substrate 63*a*, an upper carrying substrate 63*b* and a collecting substrate 63*c*. The structures of the substrates 63*a*, 63*b* and 63*c* are explained later.

The bottom carrying substrate 63*a* is provided at the bottom of the inner space of the casing 60 so as to form the bottom surface of the main toner reservoir 60*g*. That is, the bottom carrying substrate 63*a* is supported on the inner wall of the bottom plate 60*c*. Further, the bottom carrying substrate 63*a* is smoothly connected to the lower end portion of the upper carrying substrate 63*b*. The bottom carrying substrate 63*b* is connected to the lower end portion of the upper carrying substrate 63*b* so that the toner T stored in the main toner reservoir 60*g* is carried to the lower end portion of the upper carrying substrate 63*b*.

The upper carrying substrate 63*b* is supported on the inner wall of the front panel 60*b* and the top plate 60*d*. The upper carrying substrate 63*b* is configured to carry the toner T, which has passed from the bottom carrying substrate 63*a*, toward the development roller 62 and the development position DP in the toner transport direction TTD.

In this embodiment the upper end portion of the upper carrying substrate 63*b* is formed to be situated at a position higher than the center of the development roller 62. More specifically, the upper end portion of the upper carrying substrate 63*b* is formed to reach the toner supply opening 60*n*. The upper end portion of the upper carrying substrate 63*b* is formed to face the toner holding surface 62*a*, which is the cylindrical circumferential surface of the development roller 62, via a constant gap (e.g., approximately 300 μm). That is, the upper end portion of the upper carrying substrate 63*b* is formed to be a curved surface. The other part of the upper carrying substrate 63*b* is formed to have a shape of a flat plate so that the toner T is carried upward in the vertical direction.

The collecting substrate 63*c* is supported on the inner walls of the a rear side part of the top plate 60*d* relative to the toner supply opening 60*n* and the upper end portion of the rear panel 60*a*. That is, the collecting substrate 63*c* is provided at the upper potion of the communication hole 60*k* to face the upper end portion of the upper carrying substrate 63*b*. In this embodiment, the termination of the collecting substrate 63*c* in the toner transport direction TTD is situated at the position corresponding to the lower end of the development roller 62.

The collecting substrate 63*c* is configured to collect the toner T, which has not consumed at the development position DP, from the development roller 62, and to carry the collected toner T to the main toner reservoir 60*g*. More specifically, the upper half of the collecting substrate 63*c* is formed to face the development roller 62 via a constant gap (e.g., approximately 300 μm which is narrower than the gap formed at the development position DP between the development roller 62 and the photosensitive drum 3). That is, the upper half of the collecting substrate 63*c* is formed to be a curved surface. The lower half of the collecting substrate 63*c* is configured to carry the toner T downward in the vertical direction.

The bottom carrying substrate 63*a* and the upper carrying substrate 63*b* of the carrying substrate 63 are electrically connected to a carrying power circuit 64. The collecting substrate 63*c* is electrically connected to a collecting power circuit 65. The development roller 62 is electrically connected to a development bias power circuit 66.

The carrying power circuit 64, the collecting power circuit 65 and the development power circuit 66 outputs voltages required for circulating the toner T along the toner transport path TTP in the toner transport direction TTD. That is, through the output voltages of the carrying power circuit 64, the collecting power circuit 65 and the development power circuit 66, the toner T stored in the main toner reservoir 60*g* is tentatively held on the development roller 62 to supply the toner T to the development position DP, and the toner T not consumed at the development position DP is collected from the development roller 2 and is circulated to the main toner reservoir 60*g*.

More specifically, the development bias power circuit 66 outputs a voltage which has an amplitude larger than that of the collecting power circuit 65 and has a frequency equal to an integral multiple of the frequency of the output voltage of the collecting power circuit 65. The collecting power circuit 65 generates an output voltage having an average lower than the potential of the exposed part of the electrostatic latent image holding surface LS to which the toner T is to be adhered, and applies the output voltage to the collecting substrate 63*c*. Further, the output voltages of the collecting power circuit 65 and the development bias power circuit 66 are set such that the electric field between the development roller 62 and the collecting substrate 63*c* is stronger than the electric field between the development roller 62 and the photosensitive drum 3.

At a position close to the upper carrying substrate 63*b* under the development roller 62 in the inner space of the casing, a shield 67 is provided. The shield 67 is provided so that the toner T flying in the inner space of the casing 60 due to the motion of the carrying substrate 63 is prevented from being adhered to the development roller 62.

At the bottom in the inner space of the casing 60, an agitator 68 is accommodated. The agitator 68 is formed such that a rotation blade 68*a* thereof slides on the surface of the carrying substrate 63. The agitator 68 serves to fluidize the toner T. More specifically, by being rotated in a predetermined rotational direction (i.e., in the counterclockwise direction in FIG. 1) about the rotation center axis extending in the main scanning direction), the agitator stirs and fluidize the toner T, and supplies the toner T flowing over the main toner reservoir 60*g* to the toner amount adjustment chamber 60*h*.

Figure 3:
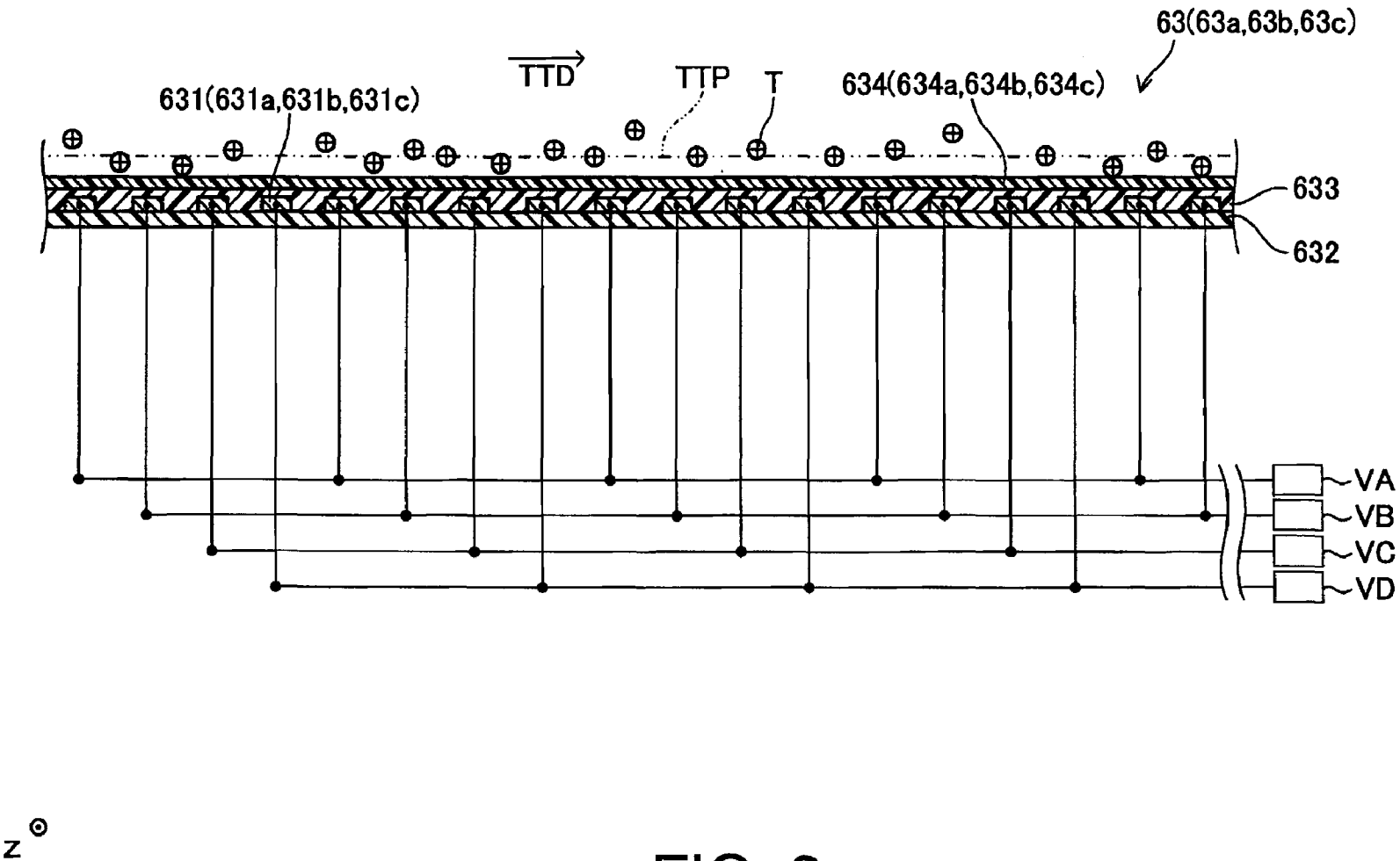
FIG. 3 is an enlarged partial side cross section of a carrying substrate provided in the toner supply device.

Referring now to FIG. 3, the carrying substrate 63 a thin plate-like member and has substantially the same structure as that of a flexible printed circuit board. More specifically, the carrying substrate 63 includes carrying electrodes 631, an electrode support film 632, an electrode coating 633 and an electrode overcoating 634.

Hereafter, the carrying electrodes 631 on the bottom carrying substrate 63*a*, the carrying electrodes 631 on the upper carrying substrate 63*b*, and the carrying electrodes 631 on the collecting substrate 63*c* are frequently referred to as bottom carrying electrodes 631*a*, vertical carrying electrodes 631*b* and collecting electrodes 631*c*, respectively. The carrying electrodes 631 are formed as linear patterns, each of which is formed to have a longer side extending in parallel with the main scanning direction perpendicular to the auxiliary scanning direction and is formed of copper foil having a thickness of several tens of μm. The plurality of carrying electrodes 631 are aligned in parallel with each other and are arranged in the toner transport path TTP.

As shown in FIG. 3, the plurality of carrying electrodes 631 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP. It should be noted that the power supply circuits VA, VB, VC and VD are provided in each of the power circuits 64 and 65.

Figure 4:
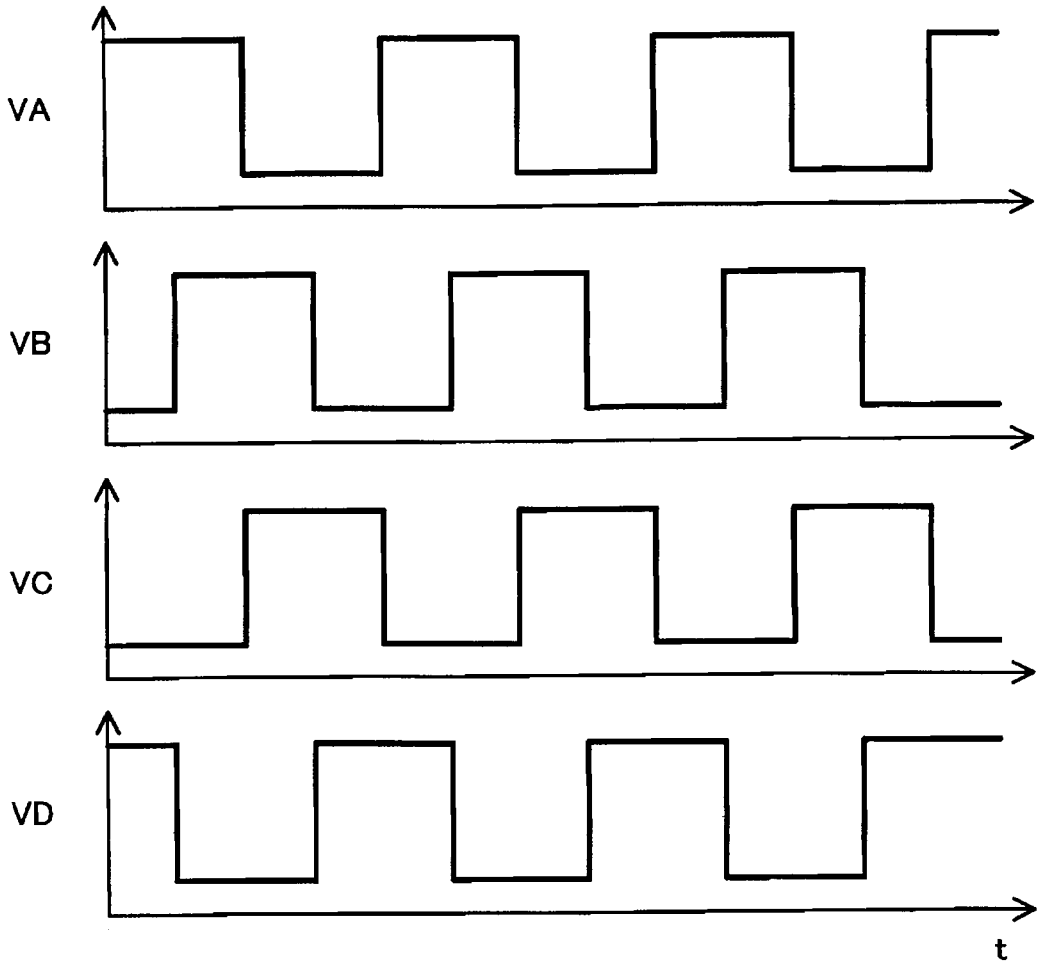
FIG. 4 is a timing chart illustrating waveforms of output signals of power supply circuits.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP so that the positively charged toner T is carried in the toner transport direction TTD.

The plurality of carrying electrodes 631 are formed on the electrode support film 632 which is formed of an insulating synthetic resin (i.e., an elastic film) such as polyimide resin.

The electrode coating 633 is made of insulating synthetic resin. The electrode coating 633 is provided to cover the carrying electrodes 631 and the surface of the electrode support film 632 on which the carrying electrodes are formed.

On the electrode coating 633, the electrode overcoating 634 is formed. Hereafter, the electrode overcoating 634 formed on the bottom carrying substrate 63*a*, the electrode overcoating 634 formed on the upper carrying substrate 63*b* and the electrode overcoating 634 formed on the collecting substrate 63*c* are frequently referred to as a bottom overcoating 634*a*, a supply overcoating 634*b*, a collecting overcoating 634*c*, respectively. That is, the electrode overcoating 633 is formed between the electrode overcoating 634 and the carrying electrodes 631. A surface of the electrode overcoating 634 is formed to be a smooth flat surface without bumps and dips so that the toner T can be carried smoothly.

In this embodiment, the supply overcoating 634*b* and the collecting overcoating 634*c* are made of the same material (e.g., polyester). That is, as the material of the supply overcoating 634*b* and the collecting overcoating 634*c*, material having a triboelectrification position on the plus side in the triboelectrification order with respect to the material (polyimide) of the bottom overcoating 634*a* is adopted. That is, the material of the supply overcoating 634*b* and the collecting overcoating 634*c* has the same electrification polarity as that of the material of the toner T with respect to the material of the bottom overcoating 634*a*.

Hereafter, operations of the laser printer 1 are described.

As shown in FIG. 1, the leading edge of the sheet of paper P placed on the paper supply tray (not shown) is supplied to the registration rollers 21. By the registration rollers 21, a skew of the sheet of paper P is corrected, and the carrying timing is adjusted. Then, the sheet of paper P is carried to the transfer position TP.

While the sheet of paper P is carried to the transfer position TP, an image by the toner T is formed on the latent image holding surface LS of the photosensitive drum 3 as described below.

First, the electrostatic latent image holding surface LS of the photosensitive drum 3 is charged by the charger 4 positively and uniformly.

The electrostatic latent image holding surface LS charged by the charger 4 moves along the auxiliary scanning direction to the scan position SP where the electrostatic latent image holding surface LS faces the scanning unit 5 by rotation of the photosensitive drum 3 in the direction indicated by the arrow in FIG. 1 (i.e., in the clockwise direction).

At the scan position SP, the laser beam LB modulated in accordance with the image information scans on the electrostatic latent image holding surface LS in the main scanning direction. In accordance with the modulated state of the laser beam LB, a part of the positive charge on the electrostatic latent image holding surface LS disappears. As a result, an electrostatic latent image which is a patter of positive charges (i.e., image pattern distribution of positive charges) is formed on the electrostatic latent image holding surface LS.

The electrostatic latent image formed on the electrostatic latent image holding surface LS moves to the development position DP where the electrostatic latent image holding surface LS faces the toner supply unit 6 by rotation of the photosensitive drum 3 in the direction indicated by the arrow in FIG. 1 (i.e., in the clockwise direction).

Referring now to FIGS. 2 and 3, the toner T stored in the casing 60 is charged by contact or friction with the bottom overcoating 634*a* of the bottom carrying substrate 63*a*. The charged toner T which contacts with or lies close to the bottom overcoating 634*a* of the bottom carrying substrate 63*a* is carried in the toner transport direction TTD and is passed to the upper carrying substrate 63*b* through the electric field generated by voltage application to the bottom carrying electrodes 631*a*.

In this embodiment, the downstream end of the bottom carrying substrate 63*a* in the toner transport direction TTD, i.e., a joint portion with the upper carrying substrate 63*b*, is formed to be a curved surface. With this structure, it becomes possible to smoothly pass the toner T from the bottom carrying substrate 63*a* to the upper carrying substrate 63*b*.

The upper carrying substrate 63*b* carries, upward in the vertical direction, the toner T passed at the lower end portion from the bottom carrying substrate 63*a*. The supply overcoating 634*b* has a lower degree of functionality of positively charging the positively charged toner T being carried than that of the bottom cover layer 634*a* of the bottom carrying substrate 63*a*. Therefore, the charged state of the developer being carried on the upper carrying substrate can be prevented from changing.

It should be noted that the toner T passed from the bottom carrying substrate 63*a* contains toner in an improperly charged state (e.g., inversely charged toner (negatively charged toner) or non-charged toner). In this regard, according to the embodiment, when the toner T is carried upward in the vertical direction by the upper carrying substrate 63*b* or when the positively toner T is held on the development roller 62 through the effect of the electric field formed between the upper carrying substrate 63*b* and the development roller 62, the improperly charged toner falls downward by the effect of the gravity or the effect of the above described electric field.

With this configuration, only the properly charged toner T is carried to the development roller 62 and the development position DP. That is, the properly charged toner and the improperly charged toner are suitably separated on the upper carrying substrate 63*b*.

As described above, the positively charged toner T is supplied to the development position DP. Around the development position DP, the electrostatic latent image formed on the electrostatic latent image holding surface LS is developed with the toner T. In other words, the toner T adheres to the part of the electrostatic latent image where the positive charges have disappeared. Thus, the image formed by the toner T (hereafter, referred to as a toner image) is held on the electrostatic latent image holding surface LS.

The toner T on the toner holding surface 62*a* which has passed the development position DP (i.e., the toner T not consumed at the development position DP) moves to the collecting substrate 63*c* through the effect of the collecting bias. That is, the toner not consumed at the development position DP is collected from the toner holding surface 62*a* by the collecting substrate 63*c*.

In this embodiment, an alternating collecting bias is applied to the development roller 62. Through the effect of an alternating component of the collecting bias, the toner T close to the toner holding surface 62*a* of the development roller 62 vibrates. By such vibration, the toner T lifted from the toner holding surface 62*a* collides with the toner T adhered to the toner holding surface 62*a*. By such a collision, the toner T held on the toner holding surface 62*a* is brought to the state of being lifted easily from the toner holding surface 62*a*.

In this embodiment, the average potential of the collecting bias is set to be lower than the potential of the exposed part of the electrostatic latent image holding surface LS to which the toner T to be supplied. Furthermore, the electric field between the development roller 62 and the collecting substrate 63*c* is stronger than the electric field between the development roller 62 and the photosensitive drum 3.

Through application of such a collecting bias, the toner T which has not consumed and passed the development position DP is suitably removed from the toner holding surface 62*a*, and is moved to the collecting substrate 63*c*. Such a configuration makes it possible to prevent occurrence of a ghost on the formed image.

In this embodiment, the amplitude of the collecting bias is set to be larger than the amplitude of the voltage applied to the collecting electrodes 631*c*. Therefore, the toner T can be suitably collected from the toner holding surface 62*a* even if the voltage between adjacent ones of the collecting electrodes 631*c* are not set to be large. As a result, the insulating property between adjacent ones of the collecting electrodes 631*c* on the collecting substrate 63*c* can be kept at a suitable state.

Furthermore, the collecting bias also serves as a bias for a jumping phenomenon at the development position DP. Consequently, it becomes possible to achieve the collecting bias with a simple structure.

The toner T which has moved from the toner holding surface 62*a* to the collecting substrate 63*c* is carried downward to the toner reservoir 61*a* through the electric field generated by the voltage application to the collecting electrodes 631*c*.

In this embodiment, the frequency of the collecting bias is set at an integral multiple of the frequency of the voltage applied to the vertical carrying electrodes 631*b* or the collecting electrodes 631*c*. As a result, the electric field of the collecting bias and the electric field for transferring the toner T on the collecting substrate 63*c* become in suitable synchronization with respect to each other.

At the lower end of the collecting substrate 63*c*, the toner T is carried downward in the vertical direction. In this case, moment in the same direction as the gravity acts on the toner T. In a region lower than the lower end of the collecting substrate 63*c*, by the effect of the moment in the same direction as the gravity, the toner T falls toward the ink reservoir 61*g*. Therefore, the toner T can be suitably circulated even if the collecting substrate 63*c* is not provided to reach the main toner reservoir 60*g*.

As shown in FIG. 1, the toner image held on the electrostatic latent image holding surface LS of the photosensitive drum 3 is carried to the transfer position TP by rotation of the electrostatic latent image holding surface LS in the direction indicated by the arrow in FIG. 1 (i.e., in the clockwise direction). Then, the toner image is transferred to the sheet of paper P from the electrostatic latent image holding surface LS at the transfer position TP.

When the stored amount of toner T in the main toner reservoir 61*n* changes, the carrying distance of the toner T in the upward direction by the upper carrying substrate 63*b* changes. In this case, the separating condition in which the properly charged toner and the improperly charged toner are separated in accordance with the charged states thereof also changes.

In view of such a fact, the toner supply unit 6 according to the embodiment is configured to such that the stored amount of toner T in the main toner reservoir 60*g* is adjusted through the communication hole 60*k* and the toner amount adjustment chamber 60*h* while the toner T is injected into the main toner reservoir 60*b* by the toner injecting unit 61*a*.

More specifically, the injecting amount of toner T by the toner injecting unit 61*a* is set to be a sufficiently larger amount. In addition, the driving state of the toner transport unit 61*b* is controlled so that the level of toner TL2 (see FIG. 2) is kept at a height which is constantly lower than the lower end of the communication hole 60*k*.

In other words, the driving amounts of toner by the toner injecting unit 61*a* and the toner transport unit 61*b* are controlled such that the ejection amount of toner ejected from the toner amount adjustment chamber 60*h* by the toner transport unit 61*b* is larger than the injecting amount of toner T by the toner injecting unit 61*a*. With this configuration, the level TL2 of the toner in the toner amount adjustment chamber 60*h* is set to be constantly lower than the level TL1 of toner in the main toner reservoir 60*g*.

In this case, the toner T in the main toner reservoir 60*g* is fluidized by the agitator 68 and therefore the toner T behaves like a liquid. In particular, the blade 68*a* of the agitator 68 rotates in the direction for carrying the toner T from the main toner reservoir 60*g* to the toner amount adjustment chamber 60*h*

Therefore, the toner T smoothly flows over the main toner reservoir 60*g* toward the toner amount adjustment chamber 60*h* through the communication hole 60*k*. As a result, the level TL1 of toner in the main toner reservoir 60*g* is kept at a constant level around the position of the lower end of the communication hole 60*k*. That is, the stored amount of toner T in the main toner reservoir 60*g* can be suitably adjusted.

As described above, according to the embodiment, since the stored amount of toner T in the main toner reservoir 60*g* is adjusted to be a constant level, the carrying distance of toner T in the upward direction by the upper carrying substrate 63*b* is also kept constant. Consequently, the separating condition in which the properly charged toner and the improperly charged toner are separated along the upper carrying substrate 63*b* is maintained properly. Therefore, according to the embodiment, the supplying state of toner T is to be proper. As a result, the image formation can be performed suitably.

Although the present invention has been described in considerable detail with reference to certain preferred embodiments thereof, other embodiments are possible.

(a) The application of the toner supply unit according to the embodiment is not limited to a monochrome laser printer. The toner supply unit 6 may be applied to various types of electrophotographic image forming devices, such as a color laser printer, a monochrome copying device, and a color copying device. In regard to the types of a photosensitive body provided in an image forming device to which the toner supply unit is applied, it is understood that the photosensitive body can take various types of shapes. That is, the shape of the photosensitive body is not limited to the drum-like shape. For example, the photosensitive body may be formed to be a plate-like shape or an endless belt. A light source for exposing a photosensitive body is not limited to a laser scanning unit. For example, an LED, an EL (electroluminescence) device, a fluorescence device may be used as a light source for exposing the photosensitive body.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(b) The main part and the auxiliary tank 60*f* of the casing 60 may be formed such that the auxiliary tank can be detachably attachable to the main part. Alternatively, the auxiliary tank 60*f* may be fixed to the main part so that he auxiliary tank 60*f* can not be detached from the main part.

Similarly, the casing 60 and the toner injecting unit 61*a* may be configured such that the toner injecting unit 61*a* can be detachably attachable to the casing 60. Alternatively, the toner injecting unit 61*a* may be formed integrally with the casing 60.

(c) The main part of the upper carrying substrate 63*b* (i.e., the flat part of the upper carrying substrate 63*b* other than the upper end portion) may be inclined with respect to the vertical direction to some extent. Similarly, the correcting substrate 63*c* may be provided to be inclined with respect to the vertical direction to some extent.

(d) The center portion of the bottom carrying substrate 63*a* may be formed to have a flat shape. In other words, the bottom carrying substrate 63*a* may formed such that only the joint portion with the lower end portion of the upper carrying substrate 63*b* is formed to be a curved surface.

(e) The collecting substrate 63*c* may be formed such that the termination of the collecting substrate 63*c* in the toner transport direction TTD reaches the supplementary toner hole 60*m*.

(f) The shield 67 may be omitted.

(g) The internal structure of the carrying substrate 63 is not limited to that shown in the above described embodiment. For example, the electrode overcoating 634 may be omitted. In this case, the material of the electrode coating 633 may be selected as in the case of the electrode overcoating 634. Alternatively, by burying the carrying electrodes 631 in the electrode support film 632, the electrode coating 633 and the electrode overcoating 634 can be omitted.

(h) The waveforms of the output voltages of the power supply circuits VA to VD are not limited to the rectangular shape shown in FIG. 4. For example, sine waveforms or triangular waveforms may be employed as output voltages of the power supply circuits VA to VD.

In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

(i) The voltage applied to the development roller 62 may be formed only of a DC component (including a ground level).

(j) The photosensitive drum 3 may contact the development roller 62.

Figure 5:
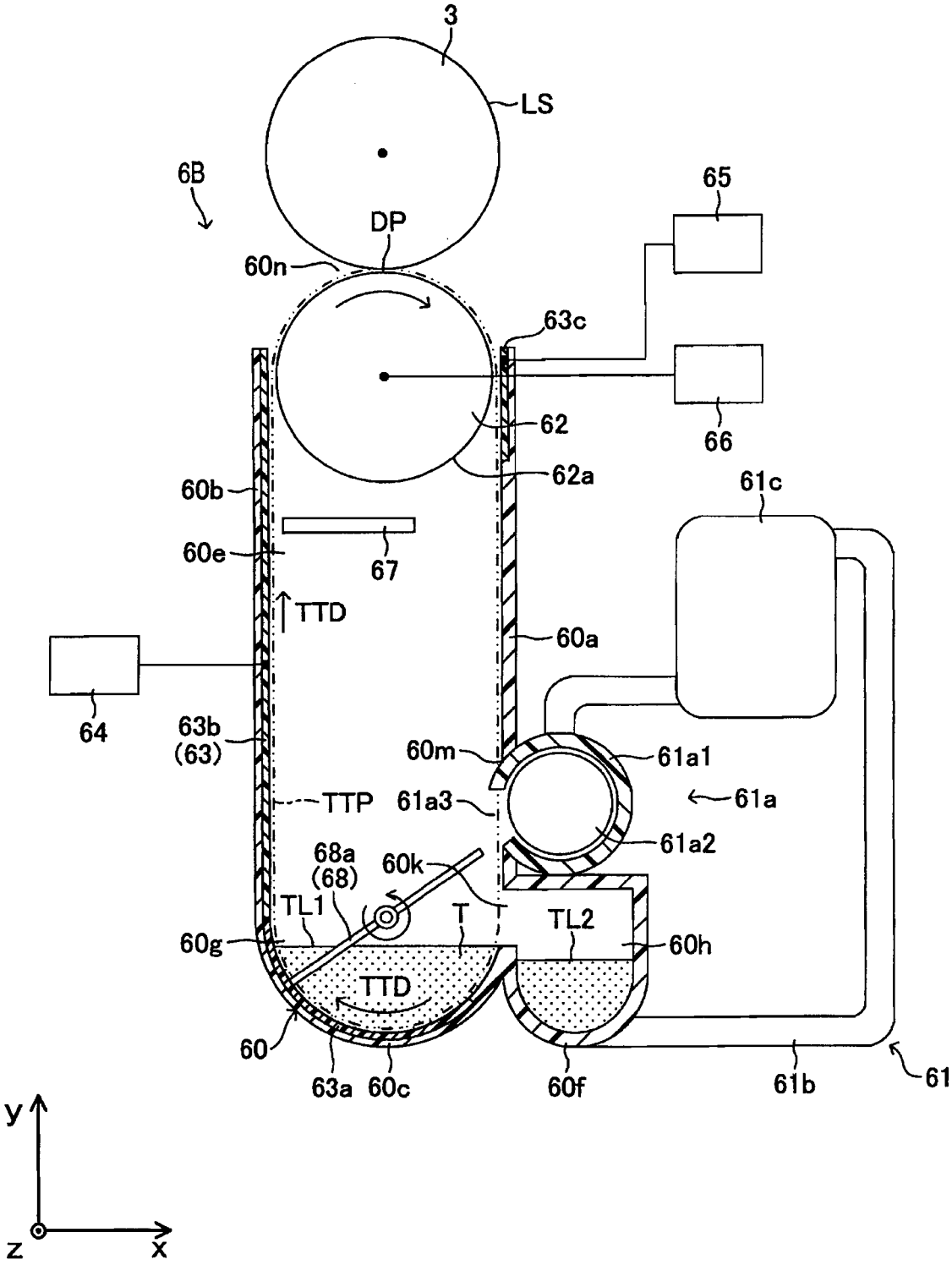
FIG. 5 is a side cross section illustrating a first variation of a toner supply unit.
Figure 6:
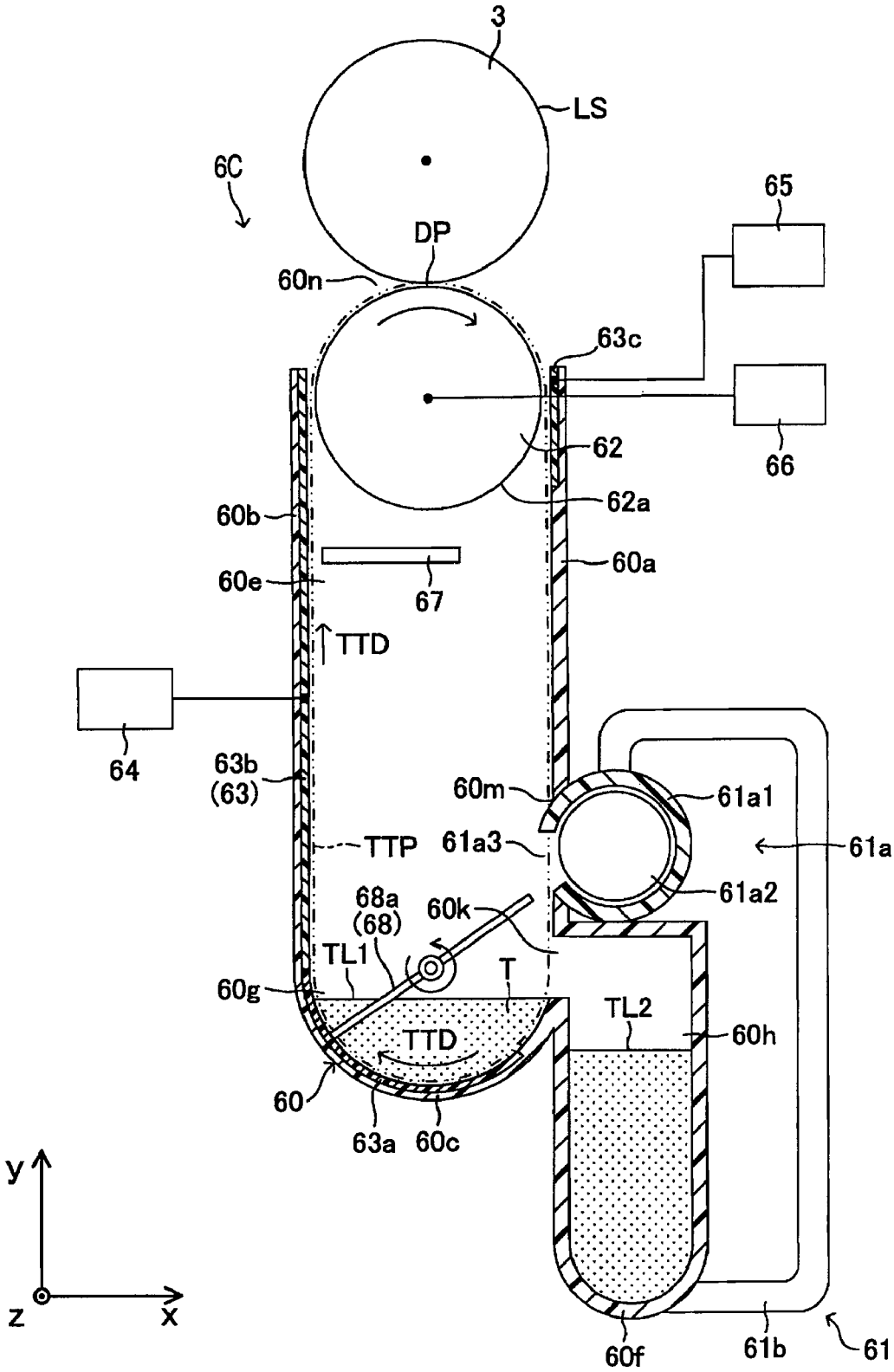
FIG. 6 is a side cross section illustrating a second variation of a toner supply unit.

(k) Referring now to FIGS. 5 and 6, first and second variations of the toner supply unit are explained. It should be noted that, in FIGS. 5 and 6, to elements which are substantially the same as those of the above described embodiment, the same reference numbers are assigned, and explanations thereof will not be repeated.

As shown in FIG. 5, a toner supply unit 6B (a first variation) is configured such that each of the upper carrying substrate 63*b* and the collecting substrate 63*c* is formed to be substantially the flat shape. In this case, the upper ends of the rear panel 60*a*, the front panel 60*b*, the upper carrying substrate 63*b* and the collecting substrate 63*c* are positioned to be higher than the rotation center of the development roller 62 so that the upper half of the development roller 62 is exposed to the outside. That is, in this case, a part of the development roller 62 is accommodated in the inside of the casing 60.

(l) The structure of the toner state control unit 61 is not limited to that shown in the above described embodiment. For example, as shown in FIG. 5, the injecting case 61*a*1 is formed not to serving as a toner tank. More specifically, the injecting case 61*a*1 may be formed to be a cylindrical member having the size for accommodating at least the injecting screw 61*a*2. In this case, a toner tank 61*c* is provided separately with respect to the injecting case 61*a*1.

In a toner supply unit 6C (the second variation) shown in FIG. 6, the toner amount adjustment chamber 60*h* is formed to have a capacity (e.g., the capacity of the injecting case 61*a*1 shown in FIG. 2) sufficiently larger than the capacity of the main toner reservoir 60*g*. In this case, the toner tank 61*c* shown in FIG. 5 can be omitted. Further, in this case, the auxiliary tank 60*f* forming the toner amount adjustment chamber 60*h* can be formed to be detachably attachable to the main part of the casing 60.

What is claimed is:

1. A developer supply device, comprising:

a casing having:

a developer reservoir provided at a bottom part of the casing to accommodate a developer;

a developer amount adjustment chamber provided close to a side of the developer reservoir to communicate with a top portion of the developer reservoir; and a communication part through which the top portion of the developer reservoir and the developer amount adjustment chamber communicate with each other, the developer supply device further comprising:

a carrying substrate having a plurality of electrodes arranged along a developer transport path to carry the developer along the developer transport path through a traveling electric field, each of the plurality of electrodes having a longer side extending in a width direction of the developer reservoir interesting with the developer transport path, and a developer providing unit configured to provide the developer into the developer reservoir, wherein the carrying substrate comprises an upper carrying substrate that is provided on an inner wall of the casing on an opposite side of the communication part, and is provided to carry the developer upward along the developer transport path.

2. The developer supply device according to claim 1, wherein:

the casing has an opening formed to be opened upward toward a supply target, the developer supply device further comprises a developer holding body that is a roller-like member having a cylindrical circumferential surface and is placed around the opening to be accommodated in the casing and to face the supply target, the developer holding body being rotated about an axis extending in the width direction of the developer reservoir;

the carrying substrate further comprises a bottom carrying substrate configured to form a bottom surface of the developer reservoir, to charge the developer by friction with the developer, and to be connected to a lower end portion of the upper carrying substrate to carry the charged developer to the lower end portion of the upper carrying substrate; and the upper carrying substrate is provided to carry the developer along the developer transport path to an upper end portion of the upper carrying substrate facing the developer holding body.

3. The developer supply device according to claim 1, wherein the communication part is formed continuously throughout an entire length of the developer holding body in the width direction.

4. The developer supply device according to claim 1, wherein the developer proving unit is formed to provide the developer into the developer reservoir uniformly throughout an entire length of the developer holding body in the width direction.

5. The developer supply device according to claim 1, further comprising a fluidizing unit configured to fluidize the developer in the developer reservoir.

6. The developer supply device according to claim 5, wherein:

the fluidizing unit comprises an agitator having a rotation blade rotated about an axis extending in the width direction of the developer reservoir; and the agitator is driven such that the developer is carried by the rotation blade from the developer reservoir to the developer amount adjustment chamber.

7. The developer supply device according to claim 2, wherein:

the carrying substrate further comprises a collecting substrate provided to face the upper end portion of the upper carrying substrate while sandwiching the developer holding body between the upper carrying substrate and the collecting substrate, so as to circulate the developer to the developer reservoir; and the communication part is provided under the collecting substrate.

8. The developer supply device according to claim 1, wherein the upper carrying substrate is provided to carry the developer upward in a vertical direction from the lower end portion to the upper end portion of the upper carrying substrate.

9. The developer supply device according to claim 1, wherein the upper carrying substrate is formed to be a plate-like member.

10. The developer supply device according to claim 1, further comprising a developer transport unit configured to connect the developer amount adjustment chamber with the developer providing unit so as to carry the developer in the developer amount adjustment chamber to the developer providing unit and to keep a level of the developer in the developer reservoir constant.

11. The developer supply device according to claim 10, wherein the developer transport unit carries the developer such that a level of the developer in the developer amount adjustment chamber is constantly lower than the level of the developer in the developer reservoir.

12. The developer supply device according to claim 10, wherein the developer transport unit carries the developer such that a carrying amount of the developer from the developer amount adjustment chamber to the developer providing unit is larger than a providing amount of the developer from the developer providing unit into the developer reservoir.

* * * * *

UNITED STATES PATENT AND TRADEMARK OFFICE

CERTIFICATE OF CORRECTION

PATENT NO. : 8,095,052 B2
APPLICATION NO. : 12/730569
DATED : January 10, 2012
INVENTOR(S) : Kenjiro Nishiwaki et al.

It is certified that error appears in the above-identified patent and that said Letters Patent is hereby corrected as shown below:

In Column 13, Claim 1, Line 10:
Replace “interesting” with --intersecting--

Signed and Sealed this
Twenty-ninth Day of May, 2012

David J. Kappos

David J. Kappos
*Director of the United States Patent and Trademark Office*